US011187170B2

(12) United States Patent
Furuhashi et al.

(10) Patent No.: US 11,187,170 B2
(45) Date of Patent: Nov. 30, 2021

(54) ROTATION SPEED CALCULATION APPARATUS

(71) Applicant: Honda Motor Co., Ltd., Tokyo (JP)

(72) Inventors: Satoshi Furuhashi, Wako (JP); Mitsuo Muraoka, Wako (JP); Nobuaki Takeo, Wako (JP); Akifumi Ikeda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/169,876

(22) Filed: Feb. 8, 2021

(65) Prior Publication Data

US 2021/0254569 A1 Aug. 19, 2021

(30) Foreign Application Priority Data

Feb. 19, 2020 (JP) ..... JP2020-025908

(51) Int. Cl.
*F02D 41/00* (2006.01)

(52) U.S. Cl.
CPC ..... *F02D 41/0097* (2013.01); *F02D 41/009* (2013.01); *F02D 2200/101* (2013.01)

(58) Field of Classification Search
CPC ..... F02D 41/0097; F02D 41/009; F02D 2200/101; G01P 3/489; G01P 3/44; G01M 15/046
See application file for complete search history.

(56) References Cited

U.S. PATENT DOCUMENTS 1,778,795 A * 10/1930 Craig ..... G01R 1/30 324/120
3,359,492 A * 12/1967 Friedrich ..... G01D 5/145 324/164
4,779,214 A * 10/1988 Kinugasa ..... F02D 41/0097 701/110
6,334,094 B1 * 12/2001 Hirakata ..... F02D 41/0097 702/145
6,411,917 B1 * 6/2002 Hirakata ..... F02D 41/0097 290/38 R (Continued)

FOREIGN PATENT DOCUMENTS

JP 2007228338 A 9/2007

*Primary Examiner* — Carl C Staubach
(74) *Attorney, Agent, or Firm* — Duft & Bornsen, PC

(57) ABSTRACT

A rotation-speed-calculation-apparatus includes: a detector configured to detect a rotation-angle of an engine; and a CPU and a memory coupled to the CPU. The CPU is configured to perform: calculating an engine-speed each time the detector detects a predetermined-angle based on a time-period required for the engine to rotate the predetermined-angle; and determining whether the engine-speed calculated is in a low-rotation range equal to or lower than a threshold-value or in a high-rotation range over the threshold-value. The CPU is configured to perform: the calculating including: calculating the engine-speed based on a time-period required for the engine to rotate a first-predetermined-angle when it is determined that the engine-speed is in the low-rotation range; and calculating the engine-speed based on a time-period required for the engine to rotate a second-predetermined-angle smaller than the first-predetermined-angle when it is determined that the engine-speed is in the high-rotation range.

14 Claims, 7 Drawing Sheets

(56) References Cited

U.S. PATENT DOCUMENTS

| | | | | |
|---|---|---|---|---|
| 6,701,275 | B1 * | 3/2004 | Muratomi | F02D 41/0097 702/145 |
| 7,114,380 | B2 * | 10/2006 | Fehrenbach | F02D 41/0097 73/114.26 |
| 7,284,538 | B2 * | 10/2007 | Ishizuka | F02D 41/009 123/436 |
| 2019/0186403 | A1 * | 6/2019 | Kobayashi | F02D 41/10 |

* cited by examiner

FIG. 4A

| | NE | θa | Na | ta |
|---|---|---|---|---|
| | [rpm] | [°] | [-] | [ms] |
| LOW-ROTATION RANGE | 500 | 60 | 10 | 20.0 |
| | 2000 | 60 | 10 | 5.0 |
| | 3000 | 60 | 10 | 3.3 |
| HIGH-ROTATION RANGE | 4000 | 30 | 5 | 1.3 |
| | 5000 | 30 | 5 | 1.0 |
| | 6000 | 30 | 5 | 0.8 |

FIG. 4B

| | NE | θb | Nb | tb |
|---|---|---|---|---|
| | [rpm] | [°] | [-] | [ms] |
| LOW-ROTATION RANGE | 500 | 30 | 5 | 10.0 |
| | 2000 | 30 | 5 | 2.5 |
| | 3000 | 30 | 5 | 1.7 |
| HIGH-ROTATION RANGE | 4000 | 180 | 30 | 7.5 |
| | 5000 | 180 | 30 | 6.0 |
| | 6000 | 180 | 30 | 5.0 |

ROTATION SPEED CALCULATION APPARATUS

CROSS-REFERENCE TO RELATED APPLICATION

This application is based upon and claims the benefit of priority from Japanese Patent Application No. 2020-025908 filed on Feb. 19, 2020, the content of which is incorporated herein by reference.

BACKGROUND OF THE INVENTION

Field of the Invention

This invention relates to a rotation speed calculation apparatus for calculating rotation speed of an engine.

Description of the Related Art

A known apparatus is configured to calculate an engine speed on the basis of pulse signal occurrence intervals and to transmit the engine speed thus calculated to an in-vehicle network at predetermined intervals (for example, refer to JP 2007-228338 A). In the apparatus disclosed in JP 2007-228338 A, in order to reduce a loss or duplication of transmission data, whenever the pulse signal occurrence interval changes, the transmission interval is changed accordingly.

However, when the transmission interval is changed in accordance with a change in the pulse signal occurrence interval as in the apparatus disclosed in JP 2007-228338 A, it is difficult to stably make determinations such as a determination on detection of an invalid signal or a determination on soundness of a connected apparatus on the basis of the transmission interval. It is therefore desirable to increase the calculation accuracy of the engine speed without changing the transmission interval.

SUMMARY OF THE INVENTION

An aspect of the present invention is a rotation speed calculation apparatus, including: a detector configured to detect a rotation angle of an engine; and a CPU and a memory coupled to the CPU. The CPU is configured to perform: calculating an engine speed each time the detector detects a predetermined angle based on a time period required for the engine to rotate the predetermined angle; and determining whether the engine speed calculated is in a low-rotation range equal to or lower than a threshold value or in a high-rotation range over the threshold value. The CPU is configured to perform: the calculating including: calculating the engine speed based on a time period required for the engine to rotate a first predetermined angle when it is determined that the engine speed is in the low-rotation range; and calculating the engine speed based on a time period required for the engine to rotate a second predetermined angle smaller than the first predetermined angle when it is determined that the engine speed is in the high-rotation range.

Another aspect of the present invention is a rotation speed calculation apparatus, including: a detector configured to detect a rotation angle of an engine; and a CPU and a memory coupled to the CPU. The CPU is configured to function as: a calculation part configured to calculate an engine speed each time the detector detects a predetermined angle based on a time period required for the engine to rotate the predetermined angle; and a determination part configured to determine whether the engine speed calculated by the calculation part is in a low-rotation range equal to or lower than a threshold value or in a high-rotation range over the threshold value. The calculation part is configured to calculate the engine speed based on a time period required for the engine to rotate a first predetermined angle when it is determined by the determination part that the engine speed is in the low-rotation range and to calculate the engine speed based on a time period required for the engine to rotate a second predetermined angle smaller than the first predetermined angle when it is determined by the determination part that the engine speed is in the high-rotation range.

BRIEF DESCRIPTION OF THE DRAWINGS

The objects, features, and advantages of the present invention will become clearer from the following description of embodiments in relation to the attached drawings, in which:

FIG. 4A is a diagram for describing a rotation angle of a crankshaft and a number of crank pulses both corresponding to a sampling time when a rotation speed calculation part in FIG. 3 calculates an engine speed;

FIG. 4B is a diagram for describing a rotation angle of the crankshaft and a number of crank pulses both corresponding to a calculation interval when the rotation speed calculation part in FIG. 3 calculates the engine speed NE;

DETAILED DESCRIPTION OF THE INVENTION

A description will be given below of an embodiment of the present invention with reference to FIGS. 1 to 9B. A rotation speed calculation apparatus according to the embodiment of the present invention is applied to an engine, such as a gasoline engine or a diesel engine, capable of producing a rotational driving force.

Figure 1:
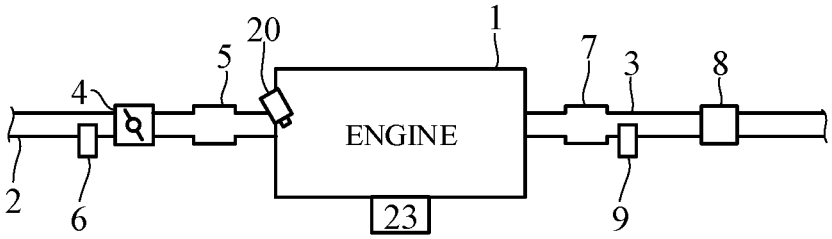
FIG. 1 is a diagram schematically showing an example of a structure containing an engine to which a rotation speed calculation apparatus according to an embodiment of the present invention is applied and peripheral components of the engine.

FIG. 1 is a diagram schematically showing an example of a structure containing an engine 1 to which the rotation speed calculation apparatus according to the embodiment of the present invention is applied and peripheral components of the engine 1. The engine 1 is mounted on a vehicle (not shown) and serves as, for example, a four-stroke spark-ignition engine having four cylinders. As shown in FIG. 1, to the engine 1, an intake passage 2 through which sucked air (intake air) to be drawn into the engine 1 passes and an exhaust passage 3 through which exhaust gas resulting from combustion in the engine 1 passes, are connected.

The intake passage 2 is provided with a throttle valve 4 that regulates the intake of air sucked in through an air cleaner (not shown), and an intake manifold 5 that distributes the intake air passing through the throttle valve 4 to a plurality of cylinders. Provided on the upstream side of the throttle valve 4 is an air intake sensor 6 that detects the flow rate of intake air.

Figure 2:
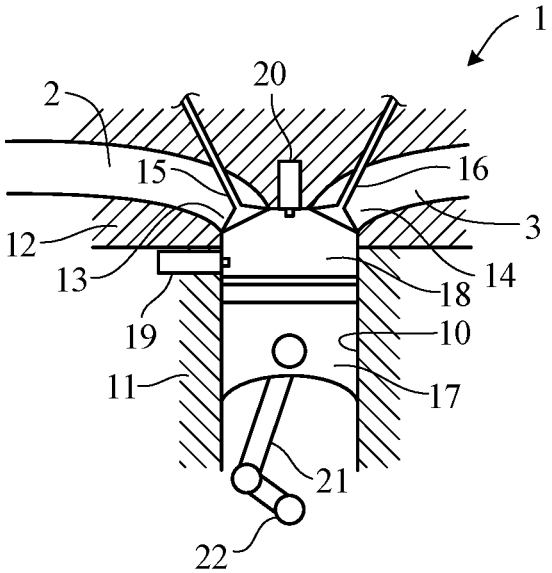
FIG. 2 is a diagram schematically showing a structure of a principal mechanism inside the engine in FIG. 1.

The exhaust passage 3 is provided with an exhaust manifold 7 that collects exhaust gases expelled from the plurality of cylinders of the engine 1, and a catalyst device 8 that cleans up the exhaust gases on the downstream side of the exhaust manifold 7. Provided on the downstream side of the exhaust manifold 7 is a LAF sensor 9 that detects the air-fuel ratio on the upstream side of the catalyst device 8. FIG. 2 is a diagram schematically showing a structure of a principal mechanism inside the engine 1. As shown in FIG. 2, the engine 1 includes a cylinder block 11 in which a plurality of cylinders 10 are provided, and a cylinder head 12 that covers an upper portion of the cylinder block 11. The cylinder head 12 is provided with an intake port 13 that communicates with the intake passage 2 and an exhaust port 14 that communicates with the exhaust passage 3. The intake port 13 is provided with an intake valve 15 that opens and closes the intake port 13, and the exhaust port 14 is provided with an exhaust valve 16 that opens and closes the exhaust port 14. The intake valve 15 and the exhaust valve 16 are driven by a valve mechanism (not shown) to open and close.

In each cylinder 10, a piston 17 is disposed slidably within the cylinder 10, and a combustion chamber 18 is provided facing the piston 17. The engine 1 is provided with an injector 19 directed toward the combustion chamber 18, and the injector 19 injects fuel into the combustion chamber 18. The engine 1 is further provided with a spark plug 20, and an air-fuel mixture in the combustion chamber 18 is ignited by the spark plug 20. When the air-fuel mixture burns (explodes) in the combustion chamber 18, the piston 17 reciprocates along an inner wall of the cylinder 10 to rotate a crankshaft 22 via a connecting rod 21.

Such an engine 1 is provided with a crank angle sensor 23 of an electromagnetic pickup type or optical type (FIG. 1) that detects a rotation angle θ of the crankshaft 22 and an engine speed NE. The crank angle sensor 23 outputs a pulse signal each time the crankshaft 22 (engine 1) rotates by a predetermined angle θ0 (for example, 6°) in response to the rotation of the engine.

Figure 3:
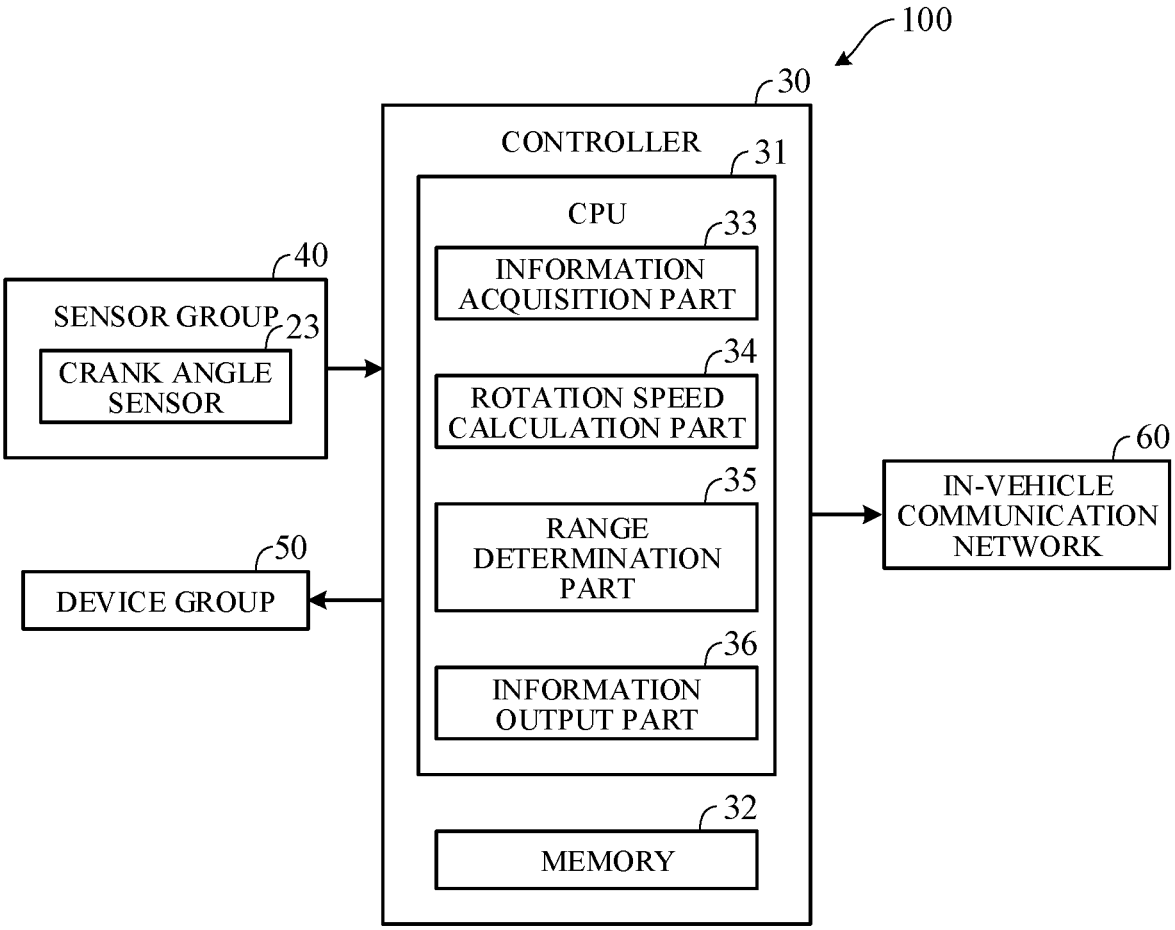
FIG. 3 is a block diagram schematically showing an example of a structure of the rotation speed calculation apparatus according to the embodiment of the present invention.

FIG. 3 is a block diagram schematically showing an example of a structure of a rotation speed calculation apparatus 100 according to the embodiment of the present invention. As shown in FIG. 3, the rotation speed calculation apparatus 100 includes a controller (engine electronic control unit (ECU)) 30 that controls the operation of the engine 1, a sensor group 40 connected to the controller 30, a device group 50, and an in-vehicle communication network 60.

The sensor group 40 includes various sensors such as the crank angle sensor 23, the air intake sensor 6, and the LAF sensor 9 for use in detecting the operating state of the engine 1. The device group 50 includes various devices such as the throttle valve 4, the injector 19, and the spark plug 20 for use in controlling the operating state of the engine 1.

The in-vehicle communication network 60 includes a plurality of controllers connected over a serial communication line such as a controller area network (CAN) communication line. The plurality of controllers include a gateway that collectively controls the operations of the plurality of controllers and relays data signals transmitted and received between the plurality of controllers, a motor ECU for use in a hybrid vehicle, and the like.

The controller 30 includes a computer that includes a CPU 31, a memory 32 such as a ROM and a RAM, and I/O and other peripheral circuits. The controller 30 calculates, in accordance with an engine control program prestored in the memory (ROM) 32, various control values on the basis of signals transmitted from the sensor group 40, and controls the operations of the device group 50 to control the operation of the engine 1. For example, the engine speed NE is calculated, each time the crankshaft 22 reaches dead center (DC) corresponding to a rotation angle of 180°, on the basis of the pulse signals transmitted from the crank angle sensor 23.

The engine speed NE calculated by the controller 30 (engine ECU) is also transmitted at predetermined intervals T (for example, 10 ms) to the other controllers connected to the in-vehicle communication network 60, thereby allowing the plurality of controllers to carry out control in a coordinated manner. For example, feedback control on the engine speed NE by the engine ECU (controller 30) and the motor ECU is carried out. In order to suitably perform such coordinated control, it is desirable to increase the calculation accuracy of the engine speed NE. Therefore, according to the present embodiment, in order to increase the calculation accuracy of the engine speed NE, the rotation speed calculation apparatus 100 is configured as follows.

As shown in FIG. 3, the CPU 31 of the controller 30 serves as an information acquisition part 33, a rotation speed calculation part 34, a range determination part 35, and an information output part 36.

The information acquisition part 33 acquires various kinds of information input from the sensor group 40 and the in-vehicle communication network 60 to the controller 30. For example, each time the crankshaft 22 rotates by the predetermined angle θ0 (for example, 6°), information on an input time of each pulse signal input from the crank angle sensor 23 is acquired. The information acquired by the information acquisition part 33 is stored in the memory (RAM) 32.

The rotation speed calculation part 34 calculates, on the basis of the information on the input time of each pulse signal stored in the memory (RAM) 32, the engine speed NE from a time (sampling time) ta taken for the crankshaft 22 to rotate by a predetermined angle θa. That is, the sampling time ta taken for a predetermined number Na of pulse signals corresponding to the predetermined angle θa to be input is converted into the engine speed NE by the following equation (i):

$$NE\ [rpm]=60000\ [ms/min]\ \theta a/(2\pi ta\ [ms]) \quad (i)$$

Further, the rotation speed calculation part 34 calculates, on the basis of the information on the input time of each pulse signal stored in the memory (RAM) 32, the engine speed NE each time the crankshaft 22 rotates by a predetermined angle θb. That is, the engine speed NE is calculated at intervals (calculation intervals) tb at which a predetermined number Nb of pulse signals corresponding to the predetermined angle θb are input.

FIG. 4A is a diagram for describing the rotation angle θa of the crankshaft 22 and the number of crank pulses Na both corresponding to the sampling time ta when the rotation speed calculation part 34 calculates the engine speed NE. FIG. 4B is a diagram for describing the rotation angle θb of the crankshaft 22 and the number of crank pulses Nb both corresponding to the calculation interval tb when the rotation speed calculation part 34 calculates the engine speed NE.

As shown in FIG. 4A, in a low-rotation range (a range where the engine speed NE≤3000 rpm in FIG. 4A), the rotation speed calculation part 34 calculates the engine speed NE on the basis of the sampling time ta for the crankshaft 22 to rotate by a predetermined angle θa1 (for example, 60°). In a high-rotation range (a range where the engine speed NE>3000 rpm in FIG. 4A), the rotation speed calculation part 34 calculates the engine speed NE on the basis of the sampling time ta for the crankshaft 22 to rotate by a predetermined angle θa2 (for example, 30°). The predetermined angle θa1 in the low-rotation range is set larger than the predetermined angle θa2 in the high-rotation range.

That is, in the low-rotation range, the engine speed NE is calculated on the basis of the sampling time ta for a predetermined number Na1 of pulse signals (10 pulse signals) corresponding to the predetermined angle θa1 (60°) to be input. In the high-rotation range, the engine speed NE is calculated on the basis of the sampling time ta for a predetermined number Na2 of pulse signals (5 pulse signals) corresponding to the predetermined angle θa2 (30°) to be input. In this case, the sampling time ta varies in a manner that depends on the engine speed NE.

As shown in FIG. 4B, in the low-rotation range, the rotation speed calculation part 34 calculates the engine speed NE each time the crankshaft 22 rotates by a predetermined angle θb1 (for example, 30°). Further, in the high-rotation range, the rotation speed calculation part 34 calculates the engine speed NE each time the crankshaft 22 rotates by a predetermined angle θb2 (for example, 180°). The predetermined angle θb1 in the low-rotation range is set smaller than the predetermined angle θb2 in the high-rotation range.

That is, in the low-rotation range, the engine speed NE is calculated at the calculation intervals tb at which a predetermined number Nb1 of pulse signals (5 pulse signals) corresponding to the predetermined angle θb1 (30°) are input. Further, in the high-rotation range, the engine speed NE is calculated at the calculation intervals tb at which a predetermined number Nb2 of pulse signals (30 pulse signals) corresponding to the predetermined angle θb2 (180°) are input. In this case, the calculation interval tb varies in a manner that depends on the engine speed NE.

Figure 5:
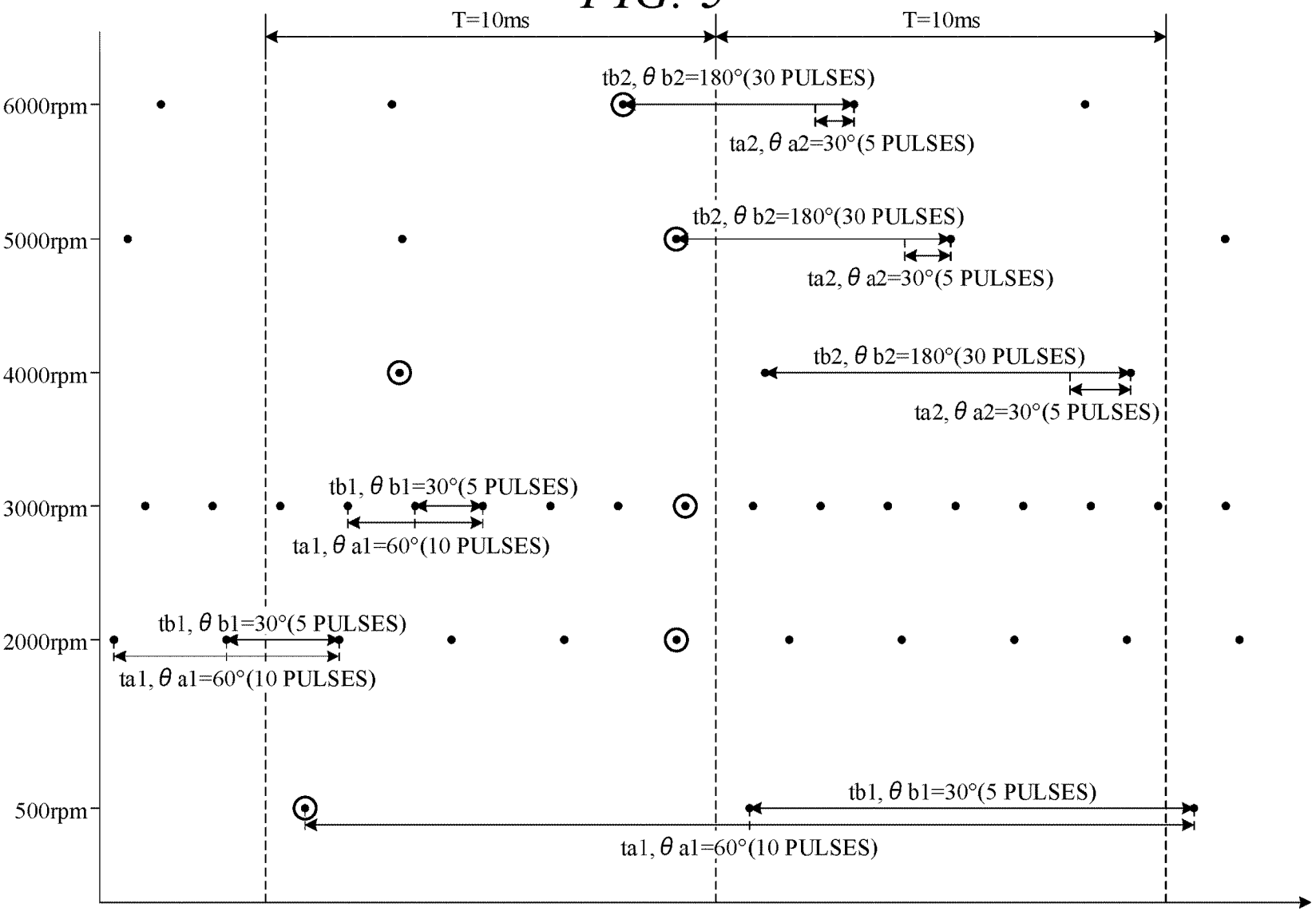
FIG. 5 is a time chart for describing the sampling time in FIG. 4A and the calculation interval in FIG. 4B.

FIG. 5 is a time chart for describing the sampling time ta and the calculation interval tb, showing an example of calculation timing for each engine speed NE with plots. As shown in FIG. 5, the lower the engine speed NE, the longer the sampling time ta. Thus, the lower the engine speed NE, the larger the smoothing degree, thereby making it less susceptible to fluctuations in the engine speed NE and in turn allowing a stable calculation of the engine speed NE. Further, since the predetermined angle θa1 in the low-rotation range is set larger than the predetermined angle θa2 in the high-rotation range, the lower the engine speed NE in the low-rotation range, the more stably the engine speed NE can be calculated.

Further, the higher the engine speed NE, the shorter the sampling time ta. Thus, the higher the engine speed NE, the smaller the smoothing degree, thereby making responsiveness to the fluctuations in the engine speed NE higher. Further, since the predetermined angle θa2 in the high-rotation range is set smaller than the predetermined angle θa1 in the low-rotation range, the higher the engine speed NE in the high-rotation range, the higher the responsiveness to the fluctuations in the engine speed NE can be made.

As described above, setting the predetermined angles θa1, θa2 so as to make the sampling time ta1 longer in the low-rotation range and to make the sampling time ta2 shorter in the high-rotation range allows the calculation, with high accuracy, of the engine speed NE over the entire range.

As shown in FIG. 5, the higher the engine speed NE, the shorter the calculation interval tb between the calculation timings (plots) of the engine speed NE. Thus, the lower the engine speed NE, the lower the calculation frequency, thereby lowering the calculation accuracy of the engine speed NE. Further, the higher the engine speed NE, the higher the calculation frequency, thereby increasing a computing load on the calculation of the engine speed NE.

In this regard, since the predetermined angle θb1 in the low-rotation range is set smaller than the predetermined angle θb2 in the high-rotation range, it is possible to increase the calculation frequency in the low-rotation range to increase the calculation accuracy of the engine speed NE. Further, it is possible to lower the calculation frequency in the high-rotation range to reduce the computing load on the calculation of the engine speed NE.

Further, since the predetermined angles θa1, θb1 are set so as to make the sampling time ta1 longer than the calculation interval tb1 in the low-rotation range, the smoothing degree becomes larger, thereby allowing a stable calculation of the engine speed NE. Further, since the predetermined angles θb1, θa2 are set so as to make the sampling time ta2 shorter than the calculation interval tb1 in the high-rotation range, the smoothing degree becomes smaller, thereby making the responsiveness to the fluctuations in the engine speed NE higher.

The engine speed NE calculated by the rotation speed calculation part 34 is stored in the memory (RAM) 32. More specifically, at each calculation timing as shown by plots in FIG. 5, the latest engine speed NE (latest value) calculated by the rotation speed calculation part 34 is stored in the memory (RAM) 32 to update the engine speed NE stored in the memory (RAM) 32 to the latest value.

The range determination part 35 determines whether the engine speed NE calculated by the rotation speed calculation part 34 falls within the low-rotation range that is equal to or less than a threshold Th or falls within the high-rotation range that is greater than the threshold Th. More specifically, each time the engine speed NE stored in the memory (RAM) 32 is updated to the latest value calculated by the rotation speed calculation part 34, the engine speed NE is compared with the threshold Th to make a determination as to whether the engine speed NE falls within the low-rotation range or the high-rotation range.

Further, in accordance with the determination result, the threshold Th is switched between a high-rotation threshold Th1 (for example, 3000 rpm) and a low-rotation threshold Th2 (for example, 1500 rpm) having hysteresis. That is, in the low-rotation range, the threshold Th is switched to the high-rotation threshold Th1, and in the high-rotation range, the threshold Th is switched to the low-rotation threshold Th2.

Figure 6:
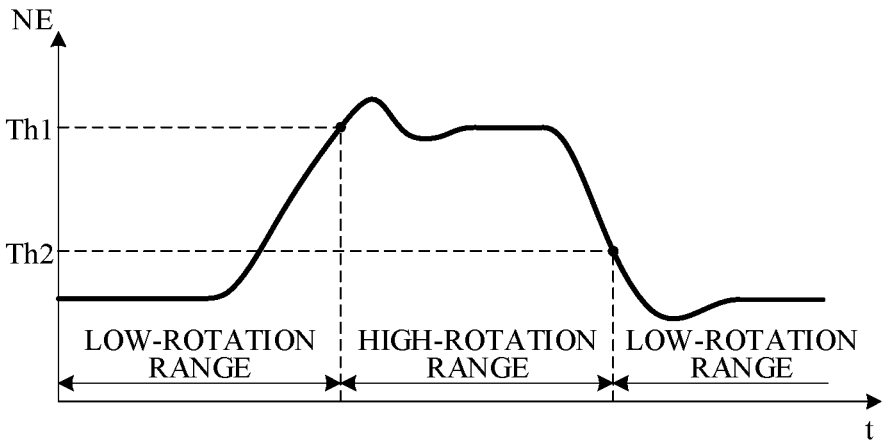
FIG. 6 is a time chart for describing a range determination made by a range determination part in FIG. 3.

FIG. 6 is a time chart for describing the range determination made by the range determination part 35. As shown in FIG. 6, in the low-rotation range, the range determination part 35 compares the engine speed NE calculated by the rotation speed calculation part 34 with the high-rotation threshold Th1 to make the range determination. Further, in the high-rotation range, the range determination part 35 compares the engine speed NE calculated by the rotation speed calculation part 34 with the low-rotation threshold Th2 to make the range determination.

As described above, imparting hysteresis to the threshold Th for use in determining whether the engine speed NE falls within the low-rotation range or the high-rotation range prevents frequent changes in the determination result even when the engine speed NE fluctuates around the threshold Th and in turn allows a stable range determination.

The information output part 36 outputs the engine speed NE calculated by the rotation speed calculation part 34, more specifically, the latest value of the engine speed NE stored in the memory (RAM) 32, to the in-vehicle communication network 60 at predetermined intervals T. In other words, as shown by plots each surrounded by a circle in FIG. 5, the engine speed NE calculated by the rotation speed calculation part 34 at a calculation timing immediately before the predetermined interval T has elapsed is output to the in-vehicle communication network 60. For example, a CAN signal is output to the in-vehicle communication network 60.

Accordingly, even when the output interval for the information output part 36 is equal to the predetermined interval T (for example, 10 ms), the engine speed NE just calculated by the rotation speed calculation part 34 of the controller 30 can be transmitted to another controller connected to the in-vehicle communication network 60. This allows the plurality of controllers to suitably perform coordinated control.

Figure 7:
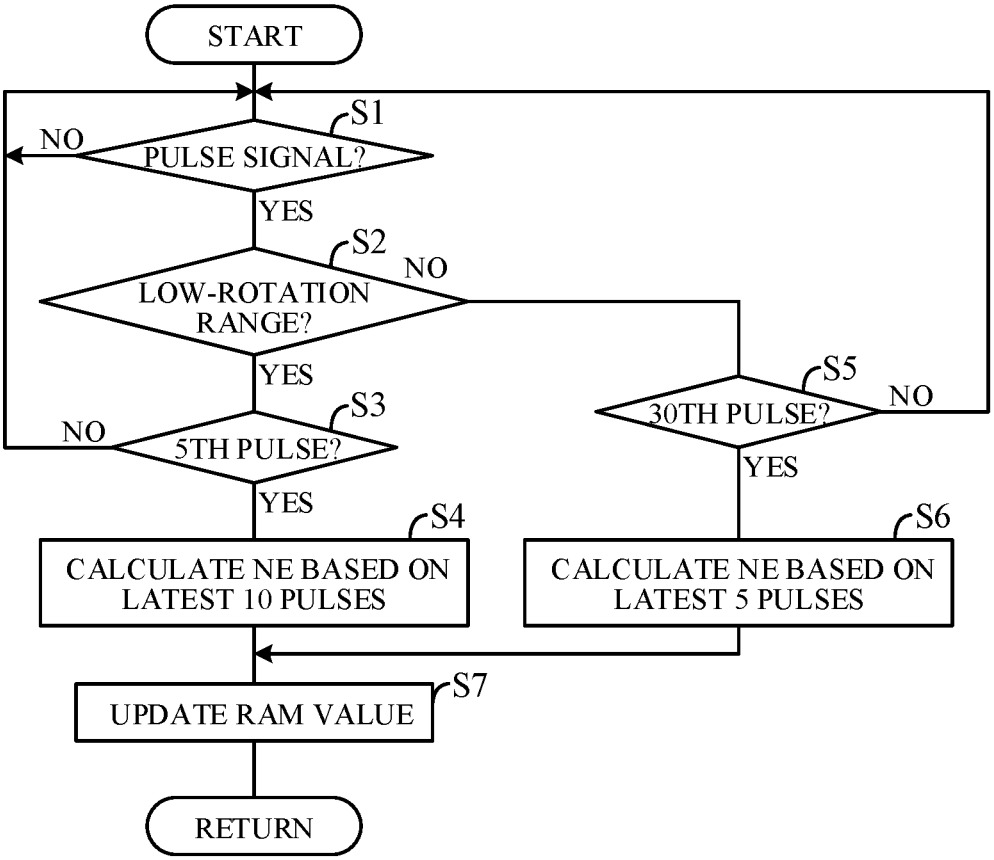
FIG. 7 is a flowchart showing an example of a process to be executed by the rotation speed calculation apparatus according to the embodiment of the present invention.

FIG. 7 is a flowchart showing an example of a process to be executed by the rotation speed calculation apparatus 100 according to the embodiment of the present invention, and shows an example of a process to be executed by the controller 30 in accordance with a program prestored in the memory (ROM) 32. The process shown in the flowchart of FIG. 7 is started upon receipt of a pulse signal from the crank angle sensor 23 and is repeated at predetermined intervals.

As shown in FIG. 7, first, when the pulse signal is input from the crank angle sensor 23, it is determined to be YES in S1 (S: process step), and the process proceeds to S2. Next, in S2, a determination is made, by the range determination part 35, as to whether the engine speed NE falls within the low-rotation range. When it is determined to be YES in S2, the process proceeds to S3, and when it is determined to be NO, the process proceeds to S5.

In S3, a determination is made, by the rotation speed calculation part 34, as to whether the predetermined number Nb1 of pulse signals (5 pulse signals in FIG. 7) corresponding to the predetermined angle θb1 have been input. When it is determined to be YES in S3, the process proceeds to S4, and when it is determined to be NO, the process returns to S1 and waits until a new pulse signal is input from the crank angle sensor 23. In S4, the engine speed NE is calculated, by the rotation speed calculation part 34, on the basis of the sampling time ta taken for the predetermined number Na1 of pulse signals (10 pulse signals in FIG. 7) corresponding to the predetermined angle θa1 to occur.

In S5, a determination is made, by the rotation speed calculation part 34, as to whether the predetermined number Nb2 of pulse signals (30 pulse signals in FIG. 7) corresponding to the predetermined angle θb2 have been input. When it is determined to be YES in S5, the process proceeds to S6, and when it is determined to be NO, the process returns to S1 and waits until a new pulse signal is input from the crank angle sensor 23. In S6, the engine speed NE is calculated, by the rotation speed calculation part 34, on the basis of the sampling time ta taken for the predetermined number Na2 of pulse signals (5 pulse signals in FIG. 7) corresponding to the predetermined angle θa2 to occur.

Next, in S7, the engine speed NE calculated in S4, S6 is stored in the memory (RAM) 32 for an update to the latest value, and the count number of pulse signals input from the crank angle sensor 23 is reset.

Figure 8:
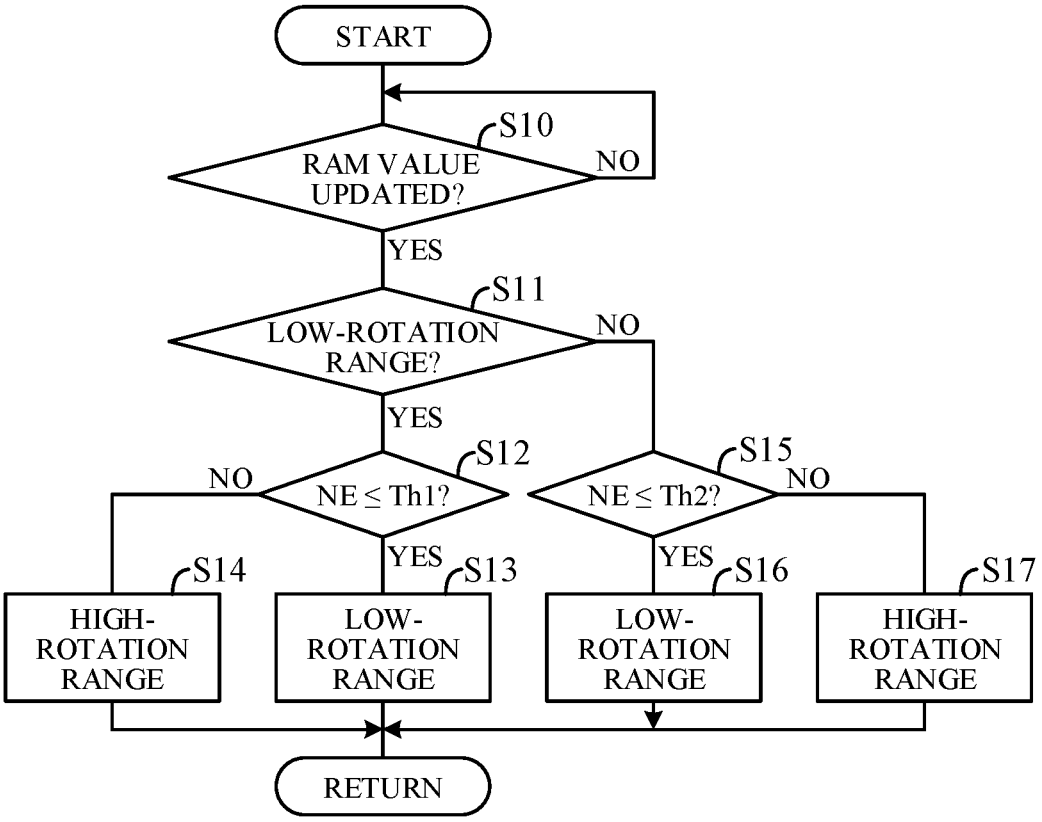
FIG. 8 is a flowchart showing an example of a range determination process to be executed by the range determination part in FIG. 3.

FIG. 8 is a flowchart showing an example of the range determination process to be executed by the range determination part 35 of the controller 30 in accordance with a program prestored in the memory (ROM) 32. The process shown in the flowchart of FIG. 8 is started upon an update of the engine speed NE stored in the memory (RAM) 32 and is repeated at predetermined intervals.

First, when the engine speed NE (RAM value) stored in the memory (RAM) 32 is updated, it is determined to be YES in step S10, and the process proceeds to step S11. Next, in step S11, a determination is made as to whether the engine speed NE falls within the low-rotation range. When it is determined to be YES, the process proceeds to step S12, and when it is determined to be NO, the process proceeds to step S15. Note that the initial value at the start of the engine 1 is set to a value within the low-rotation range.

In step S12, a determination is made as to whether the RAM value is equal to or less than the threshold Th1. When it is determined to be YES, the process proceeds to step S13 to determine that the engine speed NE falls within the low-rotation range, and when it is determined to be NO, the process proceeds to step S14 to determine that the engine speed NE falls within the high-rotation range. In step S15, a determination is made as to whether the RAM value is equal to or less than the threshold Th2. When it is determined to be YES, the process proceeds to step S16 to determine that the engine speed NE falls within the low-rotation range, and when it is determined to be NO, the process proceeds to step S17 to determine that the engine speed NE falls within the high-rotation range.

Figure 9A:
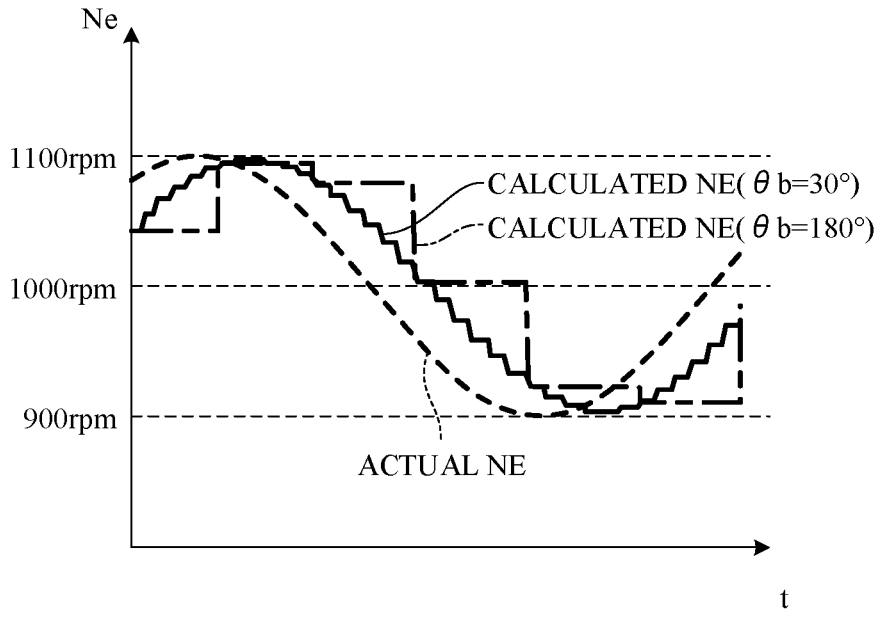
FIG. 9A is a time chart for describing effect of increase in calculation accuracy caused by increase in calculation frequency when the rotation speed calculation part in FIG. 3 calculates the engine speed around 1000 rpm.
Figure 9B:
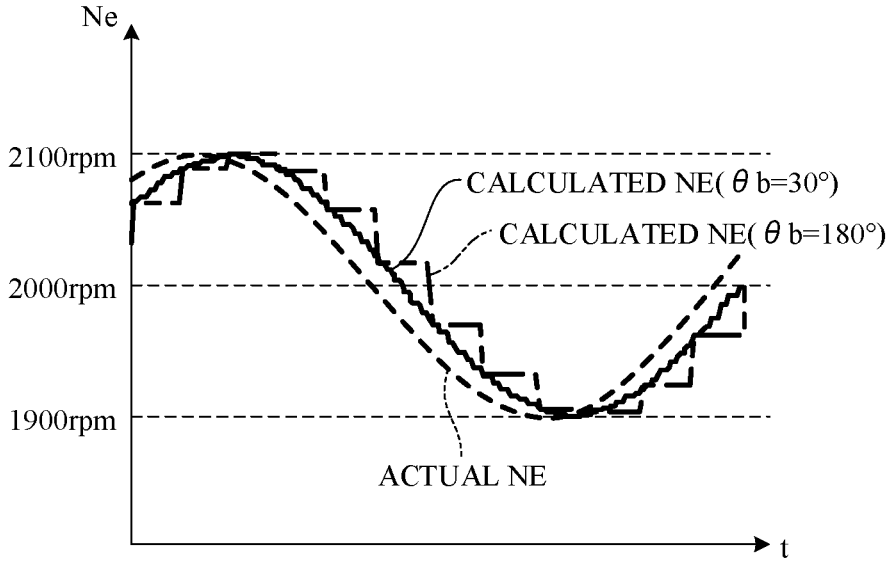
FIG. 9B is a time chart similar to FIG. 9A around 2000 rpm.

FIGS. 9A and 9B are time charts for describing the effect of an increase in calculation accuracy caused by an increase in the calculation frequency of the engine speed NE in the low-rotation range. FIGS. 9A and 9B show, with dashed lines, an actual engine speed NE caused to fluctuate around 1000 rpm and an actual engine speed NE caused to fluctuate around 2000 rpm, respectively. Further, the engine speed NE calculated by the rotation speed calculation part 34 with the predetermined angle θb set equal to 180° is shown by long dashed short dashed lines, and the engine speed NE calculated with the predetermined angle θb set equal to 30° is shown by continuous lines.

As shown in FIG. 5, the lower the engine speed NE, the longer the calculation interval tb of the engine speed NE, and the calculation frequency becomes lower accordingly; therefore, as shown in FIGS. 9A and 9B, there is a tendency where the lower the engine speed NE, the lower the calculation accuracy of the engine speed NE. Further, as shown in FIGS. 9A and 9B, as the predetermined angle θb is set smaller to increase the calculation frequency of the engine speed NE, the calculation accuracy of the engine speed NE can be further increased. Therefore, setting the predetermined angle θb1 in the low-rotation range smaller than the predetermined angle θb2 in the high-rotation range makes it possible to increase the calculation accuracy of the engine speed NE over the entire region.

The present embodiment can achieve advantages and effects such as the following:

(1) The rotation speed calculation apparatus 100 includes: the crank angle sensor 23 configured to detect the rotation angle of the engine 1; the rotation speed calculation part 34 configured to calculate the engine speed NE each time the crank angle sensor 23 detects the predetermined angle θb based on the sampling time ta required for the engine 1 to rotate the predetermined angle θa; and the range determination part 35 configured to determine whether the engine speed NE calculated by the rotation speed calculation part 34 in the low-rotation range equal to or lower than the threshold value Th or in the high-rotation range over the threshold value Th (FIG. 3).

The rotation speed calculation part 34 is configured to calculate the engine speed NE based on the sampling time ta required for the engine 1 to rotate the predetermined angle θa1 when it is determined by the range determination part 35 that the engine speed NE is in the low-rotation range. The rotation speed calculation part 34 is configured to calculate the engine speed NE based on the sampling time ta required for the engine 1 to rotate the predetermined angle θa2 smaller than the predetermined angle θa1 when it is determined by the range determination part 35 that the engine speed NE is in the high-rotation range.

That is, the predetermined angles θa1, θa2 are set so as to make the sampling time ta1 longer in the low-rotation range and to make the sampling time ta2 shorter in the high-rotation range. Thus, in the low-rotation range, the smoothing degree becomes larger, and it becomes less susceptible to the fluctuations in the engine speed NE accordingly, thereby allowing a stable calculation of the engine speed NE. In the high-rotation range, the smoothing degree becomes smaller, thereby making the responsiveness to the fluctuations in the engine speed NE higher. This in turn allows the calculation, with high accuracy, of the engine speed NE with high accuracy over the entire range.

(2) The rotation speed calculation part 34 is configured to calculate the engine speed NE each time the crank angle sensor 23 detects the predetermined angle θb1 when it is determined by the range determination part 35 that the engine speed NE is in the low-rotation range. The rotation speed calculation part 34 is configured to calculate the engine speed NE each time the crank angle sensor 23 detects the predetermined angle θb2 larger than the predetermined angle θb1 when it is determined by the range determination part 35 that the engine speed NE is in the high-rotation range.

That is, since the predetermined angle θb1 in the low-rotation range is set smaller than the predetermined angle θb2 in the high-rotation range, it is possible to increase the calculation frequency in the low-rotation range to increase the calculation accuracy of the engine speed NE. Further, it is possible to lower the calculation frequency in the high-rotation range to reduce the computing load on the calculation of the engine speed NE.

(3) The predetermined angle θa1 is larger than the predetermined angle θb1. The predetermined angle θa2 is smaller than the predetermined angle θb2. That is, since the predetermined angles θa1, θb1 are set so as to make the sampling time ta1 longer than the calculation interval tb1 in the low-rotation range, the smoothing degree becomes larger, thereby allowing a stable calculation of the engine speed NE. Further, since the predetermined angles θb1, θa2 are set so as to make the sampling time ta2 shorter than the calculation interval tb1 in the high-rotation range, the smoothing degree becomes smaller, thereby making the responsiveness to the fluctuations in the engine speed NE higher.

(4) The crank angle sensor 23 is configured to generate pulse signals in synchronization with rotation of the engine 1. The rotation speed calculation part 34 is configured to calculate the engine speed NE each time the crank angle sensor 23 generates a predetermined number Nb1 of the pulse signals corresponding to the predetermined angle θb1 based on the sampling time ta required for the crank angle sensor 23 to generate the predetermined number Na1 of the pulse signals corresponding to the predetermined angle θa1 when it is determined by the range determination part 35 that the engine speed NE is in the low-rotation range. The rotation speed calculation part 34 is configured to calculate the engine speed NE each time the crank angle sensor 23 generates the predetermined number Nb2 of the pulse signals corresponding to the predetermined angle θb2 based on the sampling time ta required for the crank angle sensor 23 to generate the predetermined number Na2 of the pulse signals corresponding to the predetermined angle θa2 when it is determined by the range determination part 35 that the engine speed NE is in the high-rotation range. For example, it is possible to calculate the engine speed NE on the basis of information on the input time of the pulse signal input from the crank angle sensor 23.

(5) The rotation speed calculation apparatus 100 further includes: the in-vehicle network 60 connected to the rotation speed calculation apparatus 100; and the information output part 36 configured to output the engine speed NE calculated by the rotation speed calculation part 34 to the in-vehicle network 60 in the predetermined time interval T (FIG. 3). The information output part 36 is configured to output the engine speed NE calculated by the rotation speed calculation part 34 immediately before a time point when the predetermined time interval T has elapsed to the in-vehicle network 60. Accordingly, even when the output interval for the information output part 36 is equal to the predetermined interval T (for example, 10 ms), the engine speed NE just calculated by the rotation speed calculation part 34 of the controller 30 can be transmitted to another controller connected to the in-vehicle communication network 60. This allows the plurality of controllers to suitably perform coordinated control.

(6) The rotation speed calculation apparatus 100 further includes: the memory (RAM) 32 configured to store the latest value of the engine speed NE calculated by the rotation speed calculation part 34 (FIG. 3). The information output part 36 is configured to output the engine speed NE stored in the memory (RAM) 32 to the in-vehicle network 60. That is, this allows the information output part 36 to output the RAM value that is updated each time the engine speed NE is calculated by the rotation speed calculation part 34 to the in-vehicle communication network 60.

(7) The range determination part 35 is configured to change the threshold value Th in accordance with a determination result as to whether the engine speed NE is in the low-rotation range or in the high-rotation range. For example, imparting hysteresis to the threshold Th prevents frequent changes in the determination result even when the engine speed NE fluctuates around the threshold Th and in turn allows a stable range determination.

The above-described embodiment may be modified into various forms. A description will be given below of a modification. According to the above-described embodiment, an example where the rotation speed calculation apparatus 100 is applied to the four-stroke spark-ignition engine 1 has been described, but the engine may be of any type as long as the engine is capable of producing a rotational driving force, and may be an external combustion engine rather than an internal combustion engine.

According to the above-described embodiment, the crank angle sensor 23 that outputs the pulse signal at every predetermined angle θ0 detects the rotation angle θ of the engine 1, but the detection part that detects the rotation angle of the engine is not limited to such a sensor. A linear signal corresponding to the rotation angle of the engine may be output.

The above embodiment can be combined as desired with one or more of the above modifications. The modifications can also be combined with one another.

According to the present invention, it becomes possible to increase the calculation accuracy of the engine speed.

Above, while the present invention has been described with reference to the preferred embodiments thereof, it will be understood, by those skilled in the art, that various changes and modifications may be made thereto without departing from the scope of the appended claims.

What is claimed is:

1. A rotation speed calculation apparatus, comprising:

a detector configured to detect a rotation angle of an engine; and a CPU and a memory coupled to the CPU, wherein the CPU is configured to perform:

calculating an engine speed each time the detector detects a predetermined angle based on a time period required for the engine to rotate the predetermined angle; and determining whether the engine speed calculated is in a low-rotation range equal to or lower than a threshold value or in a high-rotation range over the threshold value, wherein the CPU is configured to perform:

the calculating including:

calculating the engine speed based on a time period required for the engine to rotate a first predetermined angle when it is determined that the engine speed is in the low-rotation range;

calculating the engine speed based on a time period required for the engine to rotate a second predetermined angle smaller than the first predetermined angle when it is determined that the engine speed is in the high-rotation range;

calculating the engine speed each time the detector detects a third predetermined angle when it is determined that the engine speed is in the low-rotation range; and calculating the engine speed each time the detector detects a fourth predetermined angle larger than the third predetermined angle when it is determined that the engine speed is in the high-rotation range.

2. The rotation speed calculation apparatus according to claim 1, wherein the first predetermined angle is larger than the third predetermined angle, wherein the second predetermined angle is smaller than the fourth predetermined angle.

3. The rotation speed calculation apparatus according to claim 1, wherein the detector is configured to generate pulse signals in synchronization with rotation of the engine, wherein the CPU is configured to perform:

the calculating including:

calculating the engine speed each time the detector generates a third predetermined number of the pulse signals corresponding to the third predetermined angle based on a time period required for the detector to generate a first predetermined number of the pulse signals corresponding to the first predetermined angle when it is determined that the engine speed is in the low-rotation range; and calculating the engine speed each time the detector generates a fourth predetermined number of the pulse signals corresponding to the fourth predetermined angle based on a time period required for the detector to generate a second predetermined number of the pulse signals corresponding to the second predetermined angle when it is determined that the engine speed is in the high-rotation range.

4. The rotation speed calculation apparatus according to claim 1, further comprising:

an in-vehicle network connected to the rotation speed calculation apparatus, wherein the CPU is configured to perform:

outputting the engine speed calculated to the in-vehicle network in a predetermined time interval, wherein the CPU is configured to perform:

the outputting including outputting the engine speed calculated immediately before a time point when the predetermined time interval has elapsed to the in-vehicle network.

5. The rotation speed calculation apparatus according to claim 4, wherein the memory is configured to store a latest value of the engine speed calculated by the CPU, wherein the CPU is configured to perform:

the outputting including outputting the engine speed stored in the memory to the in-vehicle network.

6. The rotation speed calculation apparatus according to claim 1, wherein the CPU is configured to perform:

the determining including changing the threshold value in accordance with a determination result as to whether the engine speed is in the low-rotation range or in the high-rotation range.

7. The rotation speed calculation apparatus according to claim 6, wherein the CPU is configured to perform:

the determining including:

setting the threshold value to a first threshold value in the low-rotation range; and setting the threshold value to a second threshold value lower than the first threshold value in the high-rotation range.

8. A rotation speed calculation apparatus, comprising:

a detector configured to detect a rotation angle of an engine; and a CPU and a memory coupled to the CPU, wherein the CPU is configured to function as:

a calculation part configured to calculate an engine speed each time the detector detects a predetermined angle based on a time period required for the engine to rotate the predetermined angle; and a determination part configured to determine whether the engine speed calculated by the calculation part is in a low-rotation range equal to or lower than a threshold value or in a high-rotation range over the threshold value, wherein the calculation part is configured to calculate the engine speed based on a time period required for the engine to rotate a first predetermined angle when it is determined by the determination part that the engine speed is in the low-rotation range, to calculate the engine speed based on a time period required for the engine to rotate a second predetermined angle smaller than the first predetermined angle when it is determined by the determination part that the engine speed is in the high-rotation range, to calculate the engine speed each time the detector detects a third predetermined angle when it is determined by the determination part that the engine speed is in the low-rotation range, and to calculate the engine speed each time the detector detects a fourth predetermined angle larger than the third predetermined angle when it is determined by the determination part that the engine speed is in the high-rotation range.

9. The rotation speed calculation apparatus according to claim 8, wherein the first predetermined angle is larger than the third predetermined angle, wherein the second predetermined angle is smaller than the fourth predetermined angle.

10. The rotation speed calculation apparatus according to claim 8, wherein the detector is configured to generate pulse signals in synchronization with rotation of the engine, wherein the calculation part is configured to calculate the engine speed each time the detector generates a third predetermined number of the pulse signals corresponding to the third predetermined angle based on a time period required for the detector to generate a first predetermined number of the pulse signals corresponding to the first predetermined angle when it is determined by the determination part that the engine speed is in the low-rotation range and to calculate the engine speed each time the detector generates a fourth predetermined number of the pulse signals corresponding to the fourth predetermined angle based on a time period required for the detector to generate a second predetermined number of the pulse signals corresponding to the second predetermined angle when it is determined by the determination part that the engine speed is in the high-rotation range.

11. The rotation speed calculation apparatus according to claim 8, further comprising:

an in-vehicle network connected to the rotation speed calculation apparatus, wherein the CPU is configured to function as:

an output part configured to output the engine speed calculated by the calculation part to the in-vehicle network in a predetermined time interval, wherein the output part is configured to output the engine speed calculated by the calculation part immediately before a time point when the predetermined time interval has elapsed to the in-vehicle network.

12. The rotation speed calculation apparatus according to claim 11, wherein the memory is configured to store a latest value of the engine speed calculated by the calculation part, wherein the output part is configured to output the engine speed stored in the memory to the in-vehicle network.

13. The rotation speed calculation apparatus according to claim 8, wherein the determination part is configured to change the threshold value in accordance with a determination result as to whether the engine speed is in the low-rotation range or in the high-rotation range.

14. The rotation speed calculation apparatus according to claim 13, wherein the determination part is configured to set the threshold value to a first threshold value in the low-rotation range and to set the threshold value to a second threshold value lower than the first threshold value in the high-rotation range.

* * * * *